US009765957B2

(12) United States Patent
Hurtig

(10) Patent No.: US 9,765,957 B2
(45) Date of Patent: Sep. 19, 2017

(54) LAMP ARRANGEMENT

(71) Applicant: Naplit Show Oy, Liminka (FI)

(72) Inventor: Keijo Hurtig, Liminka (FI)

(73) Assignee: NAPLIT SHOW Oy, Liminka (FI)

( * ) Notice: Subject to any disclaimer, the term of this patent is extended or adjusted under 35 U.S.C. 154(b) by 58 days.

(21) Appl. No.: 14/868,853

(22) Filed: Sep. 29, 2015

(65) Prior Publication Data

US 2016/0097524 A1 Apr. 7, 2016

(30) Foreign Application Priority Data

Oct. 3, 2014 (FI) ..... 20145864

(51) Int. Cl.

| | |
|---|---|
| ***F21V 29/83*** | (2015.01) |
| ***F21V 7/06*** | (2006.01) |
| ***F21V 29/503*** | (2015.01) |
| *F21Y 115/10* | (2016.01) |
| *F21Y 107/90* | (2016.01) |

(52) U.S. Cl.

CPC ..... *F21V 29/83* (2015.01); *F21V 7/06* (2013.01); *F21V 29/503* (2015.01); *F21Y 2107/90* (2016.08); *F21Y 2115/10* (2016.08)

(58) Field of Classification Search

CPC ..... F21V 29/83; F21V 29/503; F21V 7/06; F21Y 2107/90; F21Y 2115/10

See application file for complete search history.

(56) References Cited

U.S. PATENT DOCUMENTS

| | | | | |
|---|---|---|---|---|
| 2007/0230172 | A1* | 10/2007 | Wang | F21V 29/004 362/249.01 |
| 2007/0253202 | A1* | 11/2007 | Wu | F21V 29/006 362/294 |
| 2008/0285265 | A1* | 11/2008 | Boissevain | F21S 8/086 362/218 |
| 2008/0285271 | A1* | 11/2008 | Roberge | F21S 8/033 362/235 |
| 2009/0213592 | A1* | 8/2009 | Zhang | F21S 8/083 362/249.02 |

(Continued)

FOREIGN PATENT DOCUMENTS

| | | |
|---|---|---|
| EP | 2330345 A2 | 6/2011 |
| KR | 101239836 B1 | 3/2013 |

(Continued)

*Primary Examiner* — Mary Ellen Bowman
(74) *Attorney, Agent, or Firm* — BelayIP Oy

(57) ABSTRACT

The invention has a lamp arrangement (800), a casing (801) of the lamp arrangement, a cooling arrangement (814) and a light source unit (809). The light source unit has an elongated piece (811), to the side of which a light source (805) is attached, and a rear reflector (804). The elongated piece has a cooling channel (808), which extends through the light source unit. The light source unit has a reflective surface (806), which is arranged to reflect light in the direction of illumination, and additionally, the reflective surface is open in the direction of the rear reflector. Thus, light leaving from the light source in the direction of the rear reflector can be reflected by the rear reflector. Between the casing (807) of the light source unit and the casing of the lamp arrangement is a second cooling channel (802), which is in connection with the cooling arrangement.

11 Claims, 4 Drawing Sheets

(56) References Cited

U.S. PATENT DOCUMENTS

| | | | | |
|---|---|---|---|---|
| 2010/0027260 | A1* | 2/2010 | Liu | F21K 9/00 362/249.01 |
| 2010/0327725 | A1* | 12/2010 | Huang | F21V 7/0025 313/46 |
| 2011/0074296 | A1* | 3/2011 | Shen | F21V 3/00 315/112 |
| 2013/0020462 | A1* | 1/2013 | Kim | F21K 9/13 250/205 |
| 2013/0135856 | A1* | 5/2013 | Arai | F21S 10/02 362/231 |

FOREIGN PATENT DOCUMENTS

| | | | |
|---|---|---|---|
| KR | 20130113056 | A | 10/2013 |
| WO | 2009056927 | A1 | 5/2009 |
| WO | 2011124354 | A1 | 10/2011 |

* cited by examiner

LAMP ARRANGEMENT

The invention relates to a lamp arrangement having a casing, a cooling arrangement and a light source unit, which light source unit has a casing of the light source, a light source, a rear reflector arranged to reflect the light of the light source in the illumination direction of the light source unit, a substantially elongated piece made at least partially of heat-conducting material, to the side of which the light source is attached such that the light source is substantially separate from the rear reflector, which elongated piece has a first end and a second end, a protective surface, which is translucent and which protective surface is in relation to the light source in the illumination direction of the light source unit, and the protective surface is disposed to protect the inner parts of the light source unit.

PRIOR ART

It is generally known that, when designing a lamp, attention must be paid to the heating of the light source or light sources of the lamp. This must especially be remembered when using LED lights, but other types of light sources also suffer from this problem. Excessive heating affects their function by decreasing luminous efficiency as well as shortening service life. Additionally, heating places restrictions on application sites and the structure of the lamps and can even cause dangerous situations. The heating problem becomes especially significant, when high-power LED lights are used or when there are several light sources in the lamp or if the shape of the lamp is such that it is difficult to dissipate heat and light sources or lamps are too close to each other. Disposing lamps close to each other would enable more multiform lamp arrangements and the use of lower-powered light sources.

An attempt has been made to manage this heating problem, for example, by attaching to the lamp cooling pieces that transfer heat or absorb heat into them. However, this increases the size and weight of the lamp and places restrictions on the design and use of the lamps. This also cannot be used if, in the designing of the lamp, there is a desire to dispose the light source such that the cooling piece cannot be disposed in the vicinity of the light source. In this case, the cooling of the light source is exceptionally problematic.

US 2012/0106188 discloses elongated heat-conducting pieces in a lamp, which pieces are parallel with the lamp and to which light sources are attached.

Herein, however, the heat-conducting pieces are continuously heating if the lamp is used for an extended time.

SUMMARY

The object of the invention is a solution, with which the disadvantages and drawbacks of known art can be significantly decreased. In particular, the object of the invention is such a solution, which is able to cool lamps that are close to each other as well as lamps, in which the light sources, due to the structure of the lamp, cannot be disposed in the cooling piece or on its surface.

The objects of the invention are achieved by an arrangement characterized in what will be presented in the independent claim. Some preferred embodiments of the invention will be presented in the dependent claims.

The main idea of the invention is to form a lamp arrangement having a light source unit having a heat-conducting elongated piece, to the side of which a light source is attached. The elongated piece has a cooling channel for a cooling substance, and the cooling channel travels through the light source unit such that the cooling substance is not free to enter the light source unit. Additionally, the lamp arrangement has a second cooling channel between the light source unit and the casing of the lamp arrangement.

In one embodiment of a lamp arrangement according to the invention, the lamp arrangement has a casing of the lamp arrangement, a cooling arrangement and a light source unit, which light source unit has a casing of the light source, a light source, a rear reflector arranged to reflect the light of the light source in the illumination direction of the light source unit, a substantially elongated piece made at least partially of heat-conducting material, to the side of which the light source is attached such that the light source is substantially separate from the rear reflector, which elongated piece has a first end and a second end, and a protective surface, which is translucent and which protective surface is in relation to the light source in the illumination direction of the light source unit, and the protective surface is disposed to protect the inner parts of the light source unit. In one preferred embodiment of the invention, said light source unit further has a cooling channel for a cooling substance in said elongated piece, and the opening of the cooling channel is in the first end of the elongated piece, and the protective surface has an opening to the first end of the elongated piece such that the opening of the cooling channel is arranged to take cooling substance from outside the area delimited by the protective surface, and, to the site of the light source, to the heat-conducting elongated piece or to other structures of the light source unit is attached a reflective surface, which is arranged to reflect light in the direction of illumination, and the reflective surface is arranged to form an opening in the direction of the rear reflector, and between the casing of the light source unit and the casing of the lamp arrangement is a second cooling channel, which is in connection with the cooling arrangement. The rear reflector is shaped such that it is arranged to reflect light substantially over the light source and the heat-conducting piece in the direction of illumination. Further, the rear reflector can be modified to reflect light at the site of the light source over the reflective surface attached to the heat-conducting piece.

In one embodiment of a lamp arrangement according to the invention, said elongated piece is substantially parallel with the illumination direction of the light source unit and extends through the light source unit. By the illumination direction is meant that direction, in which the light of the light source unit is primarily intended to be directed. Preferably, the illumination direction can be parallel with the longitudinal axis of the light source unit.

In a second embodiment of a lamp arrangement according to the invention, the light source unit has behind the rear reflector in relation to the illumination direction of the light source unit a cooling piece, which is arranged to be cooled by the cooling channel and second cooling channel, when cooling substance travels in the cooling channels.

In a third embodiment of a lamp arrangement according to the invention, the light source unit has two or more light sources in said elongated piece.

In a fourth embodiment of a lamp arrangement according to the invention, the rear reflector has a design, with which a part of the surface of the rear reflector is moved closer to the light source than the rest of the surface of the rear reflector, and the design is substantially on the rear side of the light source, i.e. in the opposite direction from the illumination direction of the light source unit, and the surface of the design is arranged to reflect the light of the light source through the opening of the reflective surface essentially in the illumination direction of the light source unit.

In a fifth embodiment of a lamp arrangement according to the invention, the elongated piece is made from two or more parts and at least one part has means for transporting the energy supply of the light source.

In a sixth embodiment of a lamp arrangement according to the invention, the elongated piece extends in the lateral direction essentially over the inner parts of the light source unit from one side margin to the other.

In a seventh embodiment of a lamp arrangement according to the invention, the cross-sectional area of the cooling channel varies. In this case, the mouth of the cooling channel can be wider than the rest of the channel. The cooling channel can also have narrowings, for example, to accelerate the flow of the cooling substance or due to the disposition of the light sources or equipment these require.

In an eighth embodiment of a lamp arrangement according to the invention, there are two or more other cooling channels.

In a ninth embodiment of a lamp arrangement according to the invention, the light source unit is to be detached from and attached to the lamp arrangement.

The advantage of the invention is that it can improve cooling of the light sources of the lamps, and, in particular, the cooling of such lamp arrangements, in which there is an attempt to dispose several lamps close to each other.

The advantage of the invention is that it enables the formation of a narrower lamp, while, at the same time, achieving adequate cooling.

The advantage of the invention is also that it enables the formation of multiform lamp solutions.

The further advantage of the invention is that it enables efficient transportation of cooling substance in the vicinity of the light source.

The advantage of the invention is also that it enables cooling of the light source on two sides.

DESCRIPTION OF THE FIGURES

In the following, the invention is described in more detail by means of the accompanying figures, in which.

DETAILED DESCRIPTION OF THE FIGURES

The embodiments in the following description are only exemplary and a person skilled in the art can also implement the basic idea of the invention in some other way than is described in the description. Although the description may have references to a particular embodiment or embodiments in several places, this does not mean that the reference applies only to a single described embodiment or that the feature described would be applicable only in the one described embodiment. The individual features of two or more embodiments can be combined and thus achieved new embodiments of the invention.

It must be noted that, when the text makes a reference to behind, in front of or in the lateral directions, this is done to aid understanding the description. The front direction means the direction of illumination and the rear direction means the opposite direction as the direction of illumination. The lateral direction is the direction, which is essentially perpendicular to the front direction and the rear direction. It must be noted that, because the light field of the light source unit can be conical, fan-shaped or equivalent, as the direction of illumination can be selected the longitudinal or symmetry axis of the light field or light source unit.

Figure 1:
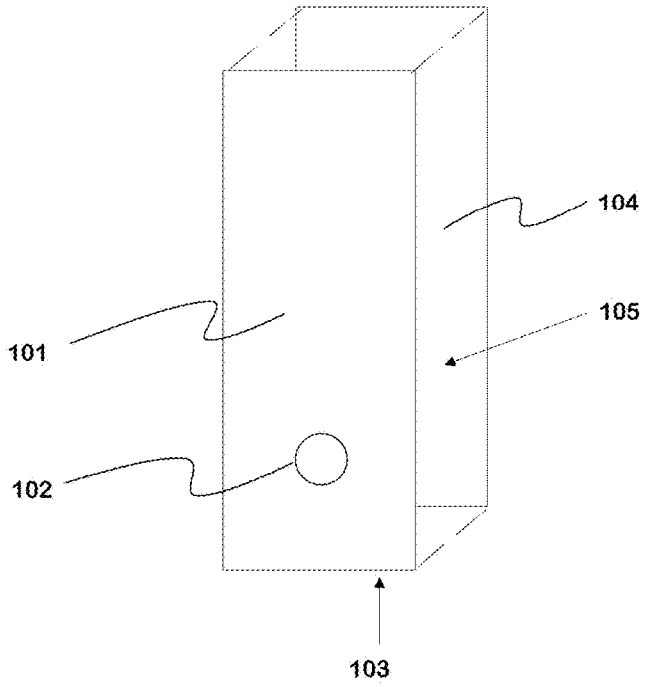
FIG. 1 shows an example of an elongated piece according to the invention.

FIG. 1 shows an example of the forming of a cooling channel 105 in a lamp according to the invention. This has two elongated pieces: a first piece 101 and a second piece 104, which are made of a heat-conducting material. This material can be, for example, aluminium or an alloy containing aluminium, but other materials are also possible. In this example, the pieces are rectangular flat pieces and essentially of the same size.

To the side of the first piece 101 is attached a light source 102. The light source is close to the end of the first piece. Similarly, to the second piece 104 is attached a second light source (not shown in the figure). The first and second pieces are disposed in the same position in relation to each other such that between them a cooling channel 105 is formed. Between the first and second pieces and connecting their sides are support pieces (not shown in the figure), which form the other walls of the channel parallelogram in cross section, when the first and second pieces form the other walls. The cooling channel 105 has at least two ends, and it is arranged to transport cooling substance. Preferably, this cooling substance is gaseous and it can be air.

The end of the channel, in the vicinity of which is the first light source 102, is the mouth 103 of the channel. The channel is arranged such that the cooling substance ends up in the mouth of the channel. This could have been implemented by arranging a vacuum in the channel or by arranging the channel such that the heated cooling substance travels in the channel. This is implemented by the cooling arrangement of the lamp arrangement. The travelling of the cooling substance in the channel is arranged such that the cooling substance cools the light source or the parts of the first piece 101 and the second piece 104 heated by the light source or light sources. Substantially, cooling occurs in the cooling channel 105 such that heated cooling substance moves away and cool cooling substance replaces it, wherein the temperature of the light sources can be controlled.

It must be noted that, in forming the channel 105, one elongated heat-conducting piece 101 is also adequate. In this case, the piece can be designed, for example, by bending or in another way such that, inside it, a channel is formed. To form the channel can, of course, also be used several elongated heat-conducting pieces. The form of the elongated pieces is also not limited. The cross section of the pieces can be, for example, curved, wherein a channel round in diameter can be formed from several pieces. The shape of the pieces can also be a combination of several shapes. The cooling channel can be formed, for example, also by drilling a hole in an elongated piece or by casting the elongated piece in the desired shape.

Figure 2:
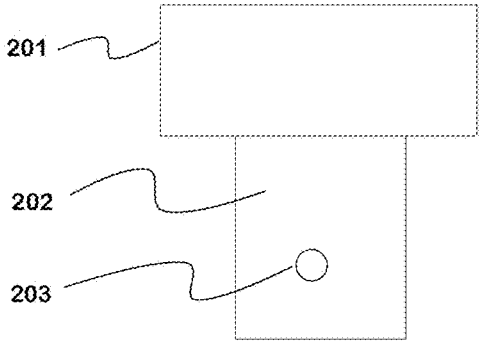
FIG. 2 shows a second example of an elongated piece according to the invention as viewed from the lateral direction.

FIG. 2 shows an example of an elongated piece according to the invention as viewed from the lateral direction. The structure is simplified to disclose the operating principle of the invention. The structure is disposed inside the light source unit. The arrangement has a cooling piece 201, an elongated piece 202 and a light source 203, which is attached to the side of the elongated piece. The light source unit has a casing structure (not shown in the figure), which is open in the illumination direction of the light source unit. On the inner surface of the casing structure can be a reflective surface for reflecting light in the illumination direction. The cooling piece is a piece, which is arranged to absorb heat created in the light source unit. The material of the cooling piece and other characteristics are selected to be suitable. The elongated piece is attached to the cooling piece. The light source unit further has a rear reflector (not shown in the figure), which reflects the light coming from the light source towards the cooling piece in the illumination direction of the light source unit. The elongated piece is substantially parallel with the illumination direction of the lamp, wherein it shades the light as little as possible. Using the elongated piece, it is possible, in addition to forming the channel, to dispose light sources at an optimal location in the lamp. In this case, the light sources are set, for example, at suitable distances from the rear reflector and in relation to the reflections on the surface of the casing. These distances and locations depend, for example, on the characteristics of the light source or the reflections or the intended use of the light source unit.

Figure 3:
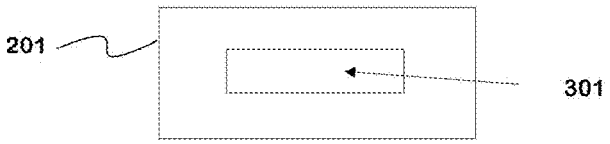
FIG. 3 shows the arrangement according to FIG. 2 as viewed from above.

FIG. 3 shows the arrangement according to FIG. 2 as viewed from above. The cooling piece 201 has a cooling channel 301.

Figure 4:
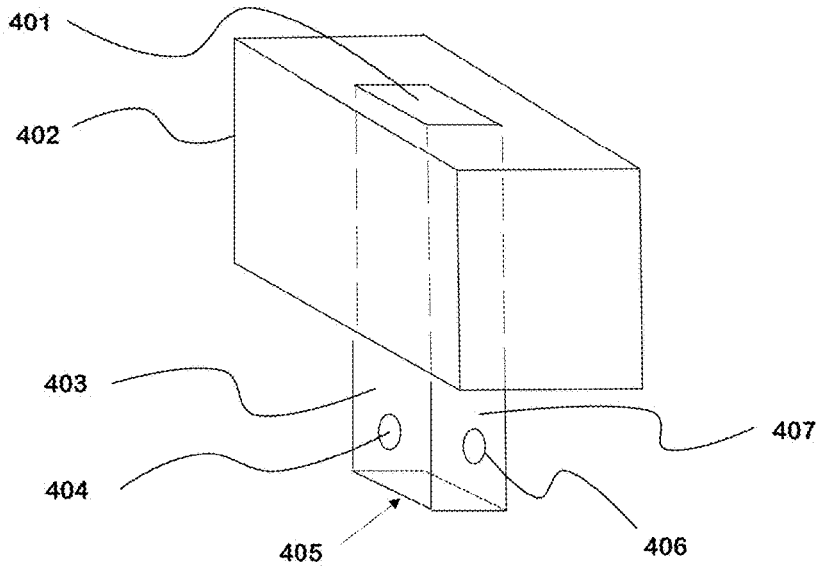
FIG. 4 shows a third example of an elongated piece according to the invention.

FIG. 4 shows a third example of an arrangement according to the invention. Inside the light source unit is a cooling piece 402, through which a cooling channel 401 is arranged to travel. The starting end of the cooling channel is formed from four elongated pieces, of which the first piece 403 and the second piece 407 are seen in the figure. The pieces are disposed such that they form a channel, the cross section of which has a shape of a parallelogram. The light source unit has a rear reflector, which is not shown in the figure, as well as a casing structure. The light source unit has four light sources, of which the first light source 404 and the second light source 406 are seen in the figure. The light sources are attached to the side of the elongated pieces. Light sources are substantially separate from the rear reflector and the casing structure of the lamp. Although the cross section of the channel is presented as a shape of a parallelogram, other implementations are, naturally, also possible.

Figure 5:
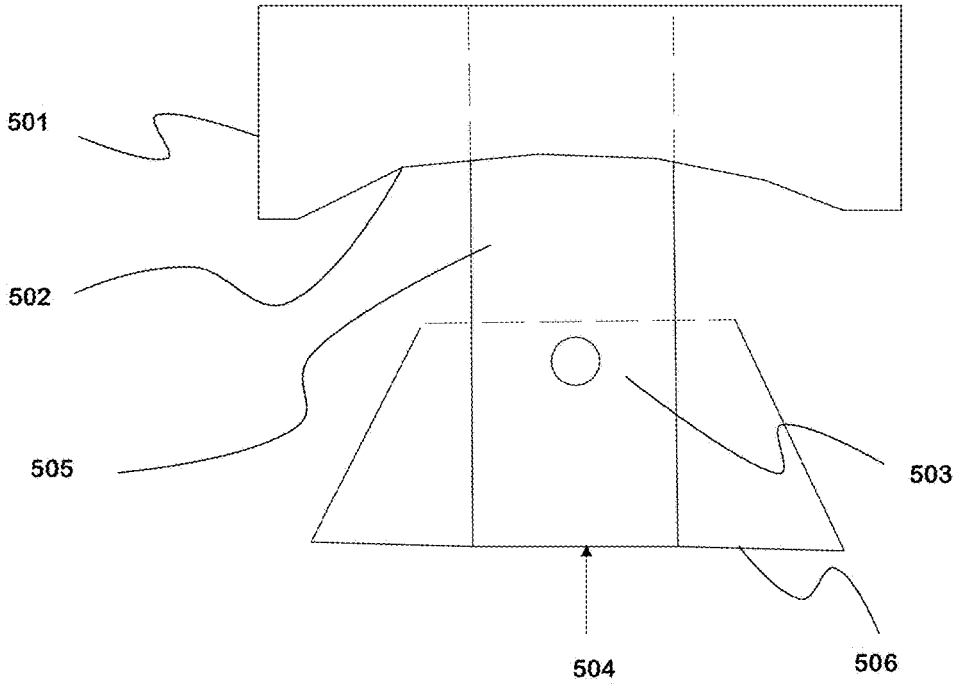
FIG. 5 shows an example of the inner parts of a light source unit according to the invention.

FIG. 5 shows an example of the inner parts of a light source unit according to the invention. The light source unit has a cooling piece 501. To the surface of the cooling piece is installed a rear reflector 502. The rear reflector can be, for example, parabolically shaped or it can be a combination of various shapes. The rear reflector can have designs for enhancing light guidance. Such can be, for example, a design, with which the light is guided such that it does not strike the light source or other structures of the light source unit. Thus, an attempt is made to avoid shadowing caused by the structures of the light source unit. The rear reflector reflects from the light source rearwards, i.e. the beams leaving against the direction of illumination. Light beams can be seen as leaving rearwards, if they are at a 45 degree or smaller angle in relation to the longitudinal axis of the lamp or the central axis of the direction of illumination. The light source unit has at least one elongated piece 505 for forming the cooling channel as well as for disposing the light source 503 in an advantageous location in relation to the rear reflectors as well as possibly the casing. The channel has a mouth 504. The light source unit has a reflective surface 506, which is at the site of the light source such that the light leaving from the light source is reflected in the direction of illumination. Thus, it is possible to gather the light leaving laterally from the light source.

Figure 6:
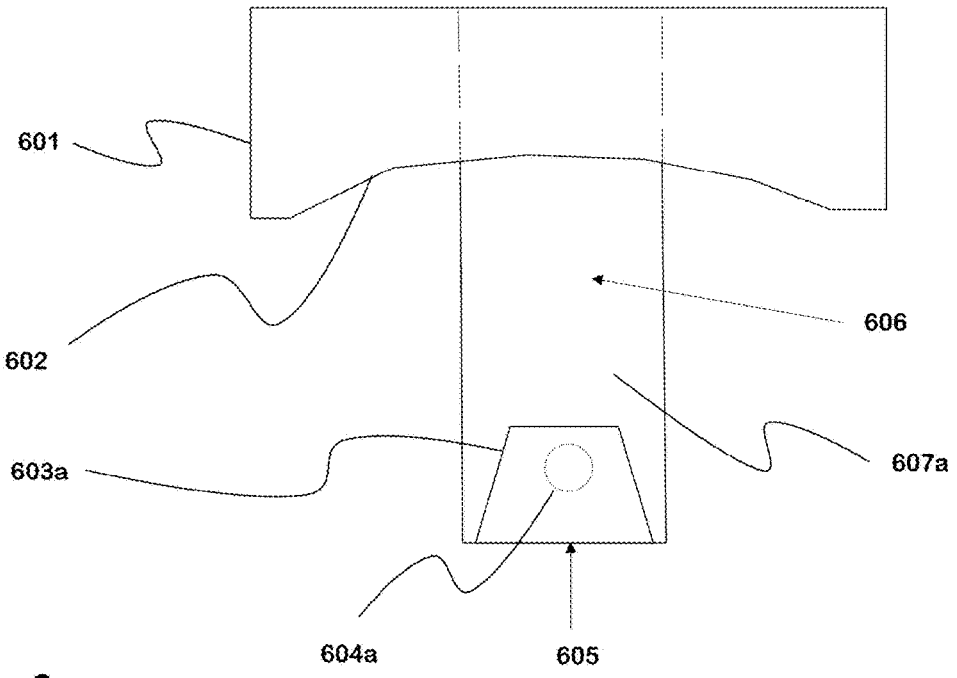
FIG. 6 shows a second example of the inner parts of a light source unit according to the invention.

FIG. 6 shows a second example of a light source unit according to the invention. The light source unit has a cooling piece 601. To the surface of the cooling piece is installed a rear reflector 602. The lamp has an elongated piece having a first part 607*a* and a second part for forming the cooling channel 606 as well as for disposing the first light source 604*a* in an advantageous location in relation to the rear reflector. The cooling channel has a mouth 605, through which the cooling substance is free to enter the channel. To the first elongated piece is attached a reflective surface 603*a*, which is arranged to reflect light in the direction of illumination, and additionally, the reflective surface is open in the direction of the rear reflector. The reflective surface is at the site of the first light source. The reflective surface has a lower edge, which is towards the direction of illumination, and an upper edge, which is towards the rear reflector. Both the lower edge and the upper edge are free from the surface of the elongated piece. The inside of the reflective surface, i.e. the surface, which is towards the light source, is reflective. Preferably, the outside can also be reflective. The reflective surface is arranged essentially such that the light of the light source, which leaves in the direction of illumination, goes in the direction of illumination, the light leaving laterally is reflected from the inside of the reflective surface in the direction of illumination, and the light leaving towards the rear reflector 602 is reflected towards the direction of illumination. The reflective surface can be, for example, a planar surface or parabolic or a combination of various shapes. Using the reflective surface, the reflections in the casing structure can be reduced and the shape of the casing structure can also be made narrower, wherein the diameter of the lamp is reduced. In this case, the size of the lamp can thus be decreased.

In the example of FIG. 6, each light source has its own reflective surface, which is attached to the same side of the elongated piece as the light source. The reflective surface can, naturally, be arranged in various ways as long as it implements the characteristics described above. In the example of FIG. 5, the reflector surface rotates around the entire elongated piece at the site of the light sources, i.e. the light sources have a common reflection surface. In this case, the reflection surface can be attached, for example, to the transparent protective plate of the light source unit.

Figure 7:
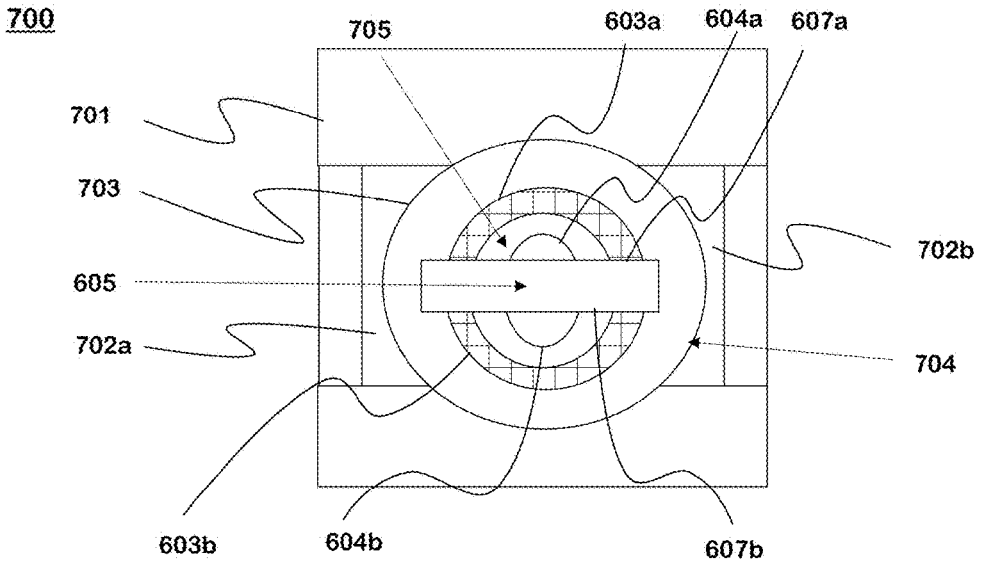
FIG. 7 shows an example of a lamp arrangement according to the invention as viewed parallel with the longitudinal axis.

FIG. 7 shows a light source unit 704 according to FIG. 6 as disposed in a lamp arrangement 700 according to the invention as viewed from below, i.e. from the direction of illumination. The lamp arrangement has a casing 701 of the lamp arrangement. The light source unit has a casing 703 of the light source, which includes at least partially the parts of the light source unit. The light source unit is positioned in the space defined by the casing of the lamp arrangement.

FIG. 7 shows the disposition of the reflective surface 603*a* and the second reflective surface 603*b* of the light source unit on the first part 607*a* and second part 607*b* of the elongated piece. The reflective surfaces reflect the light of the light sources 604*a* and 604*b* in the illumination direction of the lamp and have an opening 705 towards the rear reflector. In this example, the reflective surfaces are plate-like structures, which are attached from opposite sides on the surface of the side of the elongated piece. The reflective surface can also be implemented in other ways. The opposite sides of the reflective surface do not necessarily have to be attached to the same part of the elongated piece. The sides of the reflective surface can also be attached to other structures forming the channel. Its lower edge can reach over the lower edge of the elongated piece, i.e. over the side margin in the direction of illumination. The reflective surfaces attached to different elongated pieces can be combined. In this case, the mouth 605 of the channel can remain inside the area delimited by the reflective surfaces. There can be designs in the mouth 605 of the channel, such as narrowings or widenings or combinations of different shapes, for guiding the flow of the cooling substance. It must be noted that reflection surfaces, like light sources, do not have to be disposed symmetrically in relation to each other.

Between the casing 701 of the lamp arrangement and the casing 703 of the light source is formed an other cooling channel. This example has a first other cooling channel 702*a* and a second other cooling channel 702*b*. The other cooling channels are in connection with the cooling arrangement of the lamp arrangement.

Figure 8:
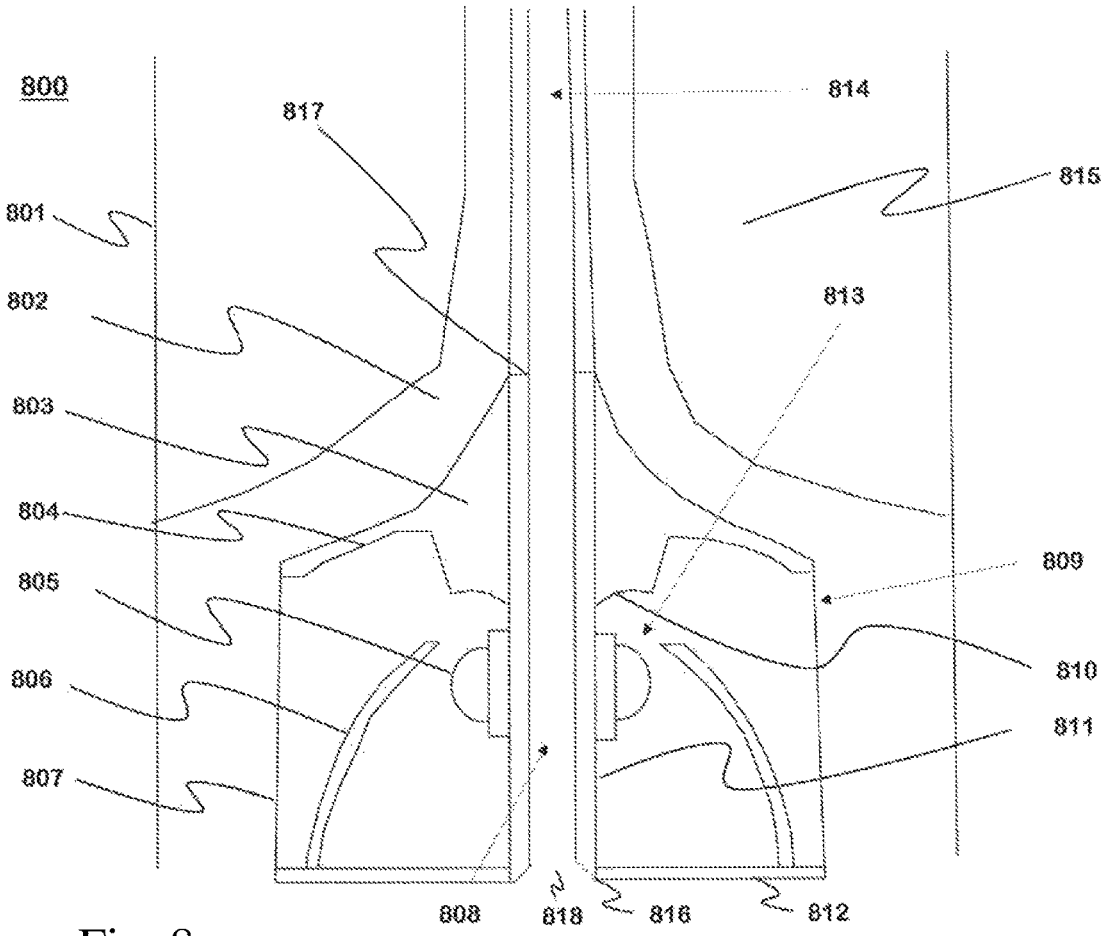
FIG. 8 shows a second example of a lamp arrangement according to the invention.

FIG. 8 shows a second example of a lamp arrangement 800 according to the invention. The lamp arrangement has a frame 801 of the lamp arrangement, a cooling arrangement 814 and a light source unit 809.

The frame 801 of the lamp arrangement protects the parts of the lamp arrangement and gives the lamp arrangement a shape, onto which the light source unit 809 or several light source units are to be attached. For the transfer of heat, the cooling arrangement 814 is arranged inside the lamp arrangement or outside of it. In this example, the cooling arrangement is formed from several channels, which transport cooling substance. The channels can be combined as one channel. The cooling arrangement can also be implemented in some other way. It is essential that it is arranged to receive the cooling substance transported by the first and second cooling channel. The lamp arrangement 800 has a cooling piece 815 of the lamp arrangement. The lamp arrangement has the necessary equipment and fittings for the function of the lamp arrangement.

The light source unit 809 includes the light sources of the light source arrangement 800. The light source unit has a cooling piece 803, on the surface of which is a rear reflector 804. The light source unit has a casing 807 of the light source protecting the lamp. A part of the casing of the light source unit is a transparent protective surface 812. The protective surface is arranged such that it admits light going in the illumination direction of the light source unit. Although, in the example, the protective surface is planar, it can also be of some other shape. In some embodiments, it can reach up to the reflector surface. The protective surface has an opening to the first end of the elongated piece such that the opening 818 of the cooling channel is arranged to take cooling substance from outside the area delimited by the protective surface.

The light source unit has an elongated piece 811, which has a cooling channel 808 for cooling substance. The elongated piece has a first end 816 and a second end 817. The cooling channel has a mouth 818 in the first end of the elongated piece. The cooling channel travels through the light source unit such that the cooling channel is in connection with the cooling arrangement 814. In this example, the cooling channel travels through the elongated piece from the first end to the second end, but the opening of the cooling channel does not need to be in the other end of the elongated piece. The elongated piece can reach even further into the light source arrangement.

The elongated piece has on its side a light source 805. The light source is preferably a LED light source. The light source unit has a reflector surface 806 essentially at the site of the light source. The reflective surface is disposed such that between the edge of the reflector surface and the surface of the side of the elongated piece remains an opening 813, from which the light of the light source is directed towards the rear reflector 804. In this example, the edge of the reflector surface reaches up to the protective surface. The reflective surface can be attached to the protective surface to stabilize the light source arrangement.

In this example, the rear reflector has a design 810 that is an elevated part of the surface of the rear reflector in the illumination direction of the lamp. The design is partially parabolic and it is arranged to reflect light from the light source that strikes it, reflecting it through the opening 813 in the illumination direction. The design can also be arranged to reflect light in the direction of illumination over the reflector surfaces, i.e. between the reflector surfaces and the frame 801 of the lamp arrangement. The design can also be arranged such that it reflects light in both of the ways described above, i.e. a part of the light striking the design is reflected through the opening and a part between the reflector surfaces and the frame. These can, of course, also be implemented by other designs of the rear reflector.

In this example, the design is elevated, i.e. it is moved towards the direction of illumination in relation to the surrounding rear reflector. The design can also be implemented as a recess, wherein it is moved away from the direction of illumination in relation to the surrounding rear reflector. The design can also be a combination of various shapes. The design surrounds the elongated piece 811 at least partially.

The lamp arrangement 800 has a second cooling channel 802, which is formed at least partially between the casing 807 of the light source unit and the casing 801 of the lamp arrangement. The casing of the light source unit forming at least one of the cooling channels is at least partially of a heat-conducting material, wherein it is heating as the light sources are used. The cooling piece 803 of the light source unit is a part of the wall of the second cooling channel. The second cooling channel is in connection with the cooling arrangement 814. The second cooling channel cools the light source unit from the outside and the cooling channel cools the light source unit from the inside. The casing of the light source unit and the casing of the lamp arrangement could have been designed such that in the second cooling channel are created designs, which guide the flow of the cooling substance.

The light source unit 809 is to be detached from and attached to the lamp arrangement 800.

Figure 9:
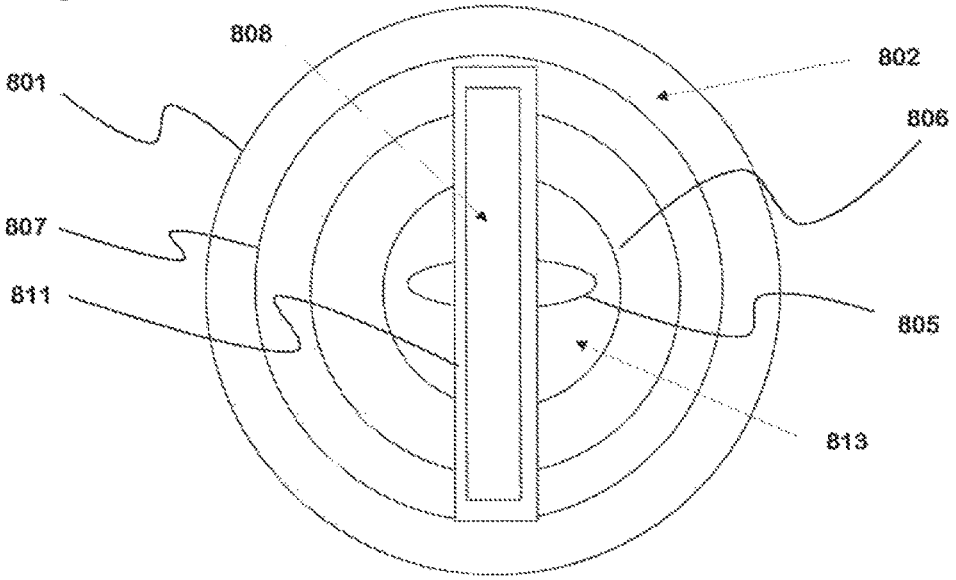
FIG. 9 shows the arrangement according to FIG. 8 as viewed from below parallel with the longitudinal axis.

FIG. 9 shows an arrangement according to FIG. 8 as viewed from the illumination direction parallel with the longitudinal axis. The figure shows a lamp arrangement, in which one light source unit 809 is in place. Between the casing 801 of the lamp arrangement and the casing 807 of the light source unit is an opening 802 to the second cooling channel, which is formed at least partially between said casings. The light source unit has an elongated piece 811 that extends in its lateral direction from one side of the casing of the light source unit to the other. Thus, the elongated piece supports the structures of the light source unit. Because the cooling channel is inside the elongated piece, it is also possible to maximize the cross-sectional area of the cooling channel. The light sources 805 and the reflector surfaces 806 are disposed respectively as in the example of FIG. 8. Between the edge of the reflector surface and the surface of the side of the elongated piece remains an opening 813, from which the light of the light source is directed towards the rear reflector.

Although, in this example, the shapes of the casing of the lamp arrangement and the light source unit are circular, other shapes are also possible.

It must be noted that the channels transporting cooling substance can branch out or unite. Further, it must be noted that the cooling substance can be arranged to travel in the channels in one direction or the other depending on the designing of the lamp. In the case of two or more channels, the lamp can be arranged such that a portion of the channels supply cooling substance and a portion lead cooling substance away, i.e. in a portion of the channels, the cooling substance travels in different directions. Further, the lamp can have additional arrangements for supplying or leading away cooling substance from the mouth of the channel. Further, it must be noted that the circulation of cooling substance in the lamp can be closed or open or a combination of these, wherein, for example, some portion of the lamp has a closed circulation of cooling substance and some other portion has an open circulation.

In the above are described some preferred embodiments of the invention. The invention is not limited only to the solutions described, rather the inventive idea can be implemented in many various ways within the limitations defined by the claims.

The invention claimed is:

1. A lamp arrangement comprising:

a casing of the lamp arrangement, a cooling arrangement, and a light source unit, said light source unit including:

a casing of the light source unit, an elongated piece made at least partially of heat-conducting material, said elongated piece having a first end and a second end, a light source attached to a side of the elongated piece, a rear reflector, separate from the light source, arranged to reflect light of the light source in an illumination direction of the light source unit, a cooling channel, for a cooling substance, in said elongated piece, said cooling channel having an opening in the first end of the elongated piece, a protective surface being disposed to protect inner parts of the light source unit and having an opening to the first end of the elongated piece such that the opening of the cooling channel is arranged to take a cooling substance from outside an area delimited by the protective surface, said protective surface being translucent and arranged in relation to the light source in the illumination direction of the light source unit, and a reflective surface, attached at the site of the light source to the elongated piece or to other structures of the light source unit, arranged to reflect light in the direction of illumination, said reflective surface being further arranged to form an opening in the direction of the rear reflector, wherein between the casing of the light source unit and the casing of the lamp arrangement is a second cooling channel in connection with the cooling arrangement.

2. The lamp arrangement according to claim 1, wherein the elongated piece is parallel with the illumination direction of the light source unit and extends through the light source unit.

3. The lamp arrangement according to claim 1, wherein the light source unit further includes, behind the rear reflector and in relation to the illumination direction of the light source unit, a cooling piece arranged to be cooled by the cooling channel and the second cooling channel when a cooling substance travels in the cooling channels.

4. The lamp arrangement according to claim 1, wherein the light source unit includes two or more light sources attached to said elongated piece.

5. The lamp arrangement according to claim 1, wherein the rear reflector has a design in which part of a surface of the rear reflector is moved closer to the light source than the rest of the surface of the rear reflector, and the design is arranged above the light source to reflect light of the light source through the opening of the reflective surface and in the illumination direction of the light source unit.

6. The lamp arrangement according to claim 1, wherein the elongated piece is made from two or more parts and at least one part has a means for transporting an energy supply for the light source.

7. The lamp arrangement according to claim 1, wherein the elongated piece extends in a lateral direction over inner parts of the light source unit from one side margin to the other.

8. The lamp arrangement according to claim 1, wherein a cross-sectional area of the cooling channel varies along its length.

9. The lamp arrangement according to claim 1, wherein there are two or more second cooling channels.

10. The lamp arrangement according to claim 1, wherein the light source unit is detachable from the lamp arrangement.

11. A light source unit, said light source unit including:

a casing, an elongated piece made at least partially of heat-conducting material, said elongated piece having a first end and a second end, a light source attached to a side of the elongated piece, a rear reflector, separate from the light source, arranged to reflect light of the light source in an illumination direction of the light source unit, a cooling channel, for a cooling substance, in said elongated piece, said cooling channel having an opening in the first end of the elongated piece, a protective surface being disposed to protect inner parts of the light source unit and having an opening to the first end of the elongated piece such that the opening of the cooling channel is arranged to take a cooling substance from outside an area delimited by the protective surface, said protective surface being translucent and arranged in relation to the light source in the illumination direction of the light source unit, and a reflective surface, attached at the site of the light source to the elongated piece or to other structures of the light source unit, arranged to reflect light in the direction of illumination, said reflective surface having an opening in the direction of the rear reflector.

* * * * *